US006726538B2

(12) United States Patent
Saguchi et al.

(10) Patent No.: US 6,726,538 B2
(45) Date of Patent: Apr. 27, 2004

(54) SAMPLE POLISHING APPARATUS AND SAMPLE POLISHING METHOD

(75) Inventors: Akihiko Saguchi, Amagasaki (JP); Wataru Takahashi, Nishinomiya (JP)

(73) Assignee: Tokyo Electron Limited, Tokyo (JP)

( * ) Notice: Subject to any disclaimer, the term of this patent is extended or adjusted under 35 U.S.C. 154(b) by 85 days.

(21) Appl. No.: 09/826,847

(22) Filed: Apr. 6, 2001

(65) Prior Publication Data

US 2001/0039167 A1 Nov. 8, 2001

(30) Foreign Application Priority Data

Apr. 7, 2000 (JP) ..... 2000-107194

(51) Int. Cl.[7] ..... B24B 7/22
(52) U.S. Cl. ..... 451/41; 451/398
(58) Field of Search ..... 451/41, 288, 287, 451/388, 398

(56) References Cited

U.S. PATENT DOCUMENTS 5,527,209 A * 6/1996 Volodarsky et al. ..... 451/283
5,820,448 A * 10/1998 Shamouilian et al. ..... 451/285
5,916,015 A * 6/1999 Natalicio ..... 451/388
6,030,275 A * 2/2000 Lofaro ..... 451/287
6,036,587 A * 3/2000 Tolles et al. ..... 451/288
6,056,632 A * 5/2000 Mitchel et al. ..... 451/286
6,080,050 A * 6/2000 Chen et al. ..... 451/288
6,210,260 B1 * 4/2001 Tanaka et al. ..... 451/289

FOREIGN PATENT DOCUMENTS

| | | |
|---|---|---|
| JP | 56-169332 | 12/1981 |
| JP | 62-101678 | 5/1987 |
| JP | 4-206930 | 7/1992 |
| JP | 8-181092 | 7/1996 |

* cited by examiner

*Primary Examiner*—Joseph J. Hail, III
*Assistant Examiner*—Anthony Ojini
(74) *Attorney, Agent, or Firm*—Finnegan, Henderson, Farabow, Garrett & Dunner, L.L.P.

(57) ABSTRACT

A sample suck pad (chuck) made of resin is stuck and fixed onto the entirety of the lower surface of a chuck base, with an adhesive layer (rubber adhesive double coated tape). The adhesive layer includes a rubber-based adhesive material and has the shearing adhesive strength of 1.96 MPa (20 kgf/cm$^2$). The outer periphery of the adhesive layer is covered with a sealing layer so that the contact of the adhesive layer with the outside is blocked off. A sample is sucked and held on the lower surface of the sample suck pad and this sample is pressed onto a polishing pad, which is fixed on a platen, so as to be polished.

20 Claims, 2 Drawing Sheets

SAMPLE POLISHING APPARATUS AND SAMPLE POLISHING METHOD

BACKGROUND OF THE INVENTION

The present invention relates to a sample polishing apparatus and a sample polishing method for polishing a sample formed of a flat plate such as a semiconductor substrate, in particular, to configurations of fixed parts of a sample suck pad and a chuck base which hold the above sample.

As for a uniform flattening polishing method of an Si wafer, a semiconductor device wafer, or the like, a CMP (Chemical Mechanical Polishing) method is known which utilizes a precision polishing apparatus, a polishing slurry, a polishing pad, and the like and which is used for the flattening of an insulating film, for a capacitor formation, for an STI (Shallow Trench Isolation) and for the formation of a plug or a metal wire of Al, Cu, W, or the like.

A sample polishing apparatus (CMP apparatus) utilized in the CMP method comprises a platen of a large diameter where a polishing pad is stuck to the entirety of the upper surface thereof and a chuck base of a small diameter of which the lower surface faces the platen and which holds a sample as the polishing object such as a semiconductor substrate on that lower surface. The chuck base and the platen both have a thick disk form which are supported by respective supporting axes perpendicular to the respective faces opposite to each other in a coaxial manner so as to rotate around these supporting axes for the operation. In addition, a diamond electrodeposition ring is arranged on the same side of the platen as the chuck base so that the lower surface thereof faces the platen. A nozzle is arranged so as to face platen between the chuck base and the electrodeposition ring so that polishing slurry is supplied to the surface of the platen from the nozzle.

The chuck base is linked to a head which carries out the positioning in the horizontal direction and in the vertical direction on the platen. A chuck (sample suck pad) is stuck to the entirety of the lower surface of the chuck base, which faces the platen, via an adhesive layer so that a sample is fixed on the chuck. In addition, a retainer for preventing the sample from flying out and for preventing excessive polishing of the edges of the sample is provided on the lower surface of the chuck. The retainer is formed of a ceramic or of a specific resin such as Teflon (registered trademark) since chemical resistance and swelling resistance to the polishing slurry as well as resistance to abrasion from the polishing pad and from the polishing grains are required.

In the case that polishing is carried out by using such an apparatus, first, a sample is fixed on the chuck and the chuck base is positioned above a predetermined circle on top of the platen by means of the head so that both are rotated while being approached each other and then the surface to be polished(lower surface) of the sample is pressed on the polishing pad with a predetermined pressure so as to make contact with each other while grinding via the polishing slurry supplied from the nozzle. In addition, in order to stabilize the polishing rate, an in-situ dress of the polishing pad is carried out by the diamond electrodeposition ring for every predetermined number of samples being polished.

As described above, at the time of polishing process of an Si wafer and a semiconductor device wafer, polishing slurry is used. As for the polishing liquid of the polishing slurry, silica sol (pH≈10.5), ceria sol (pH≈6.5) or the like are used in the case of the flattening of an insulating film. Silica sol in general has a buffer solution as a base and pH thereof is fixed to alkaline by using potassium hydroxide, ammonia, or the like. The merits of this are cited as follows: the polishing rate is stabilized through the enhancement of dispersibility of the polishing grains and the polishing rate is increased through the hydration of the silicon oxide film. In addition, in the metal polishing using Al, Cu, W, or the like, alumina is generally used as the polishing grains and a method is used where the metal surface is mechanically peeled with the polishing grains while oxidizing with an oxidant such as hydrogen peroxide. The pH of the polishing slurry of this case is, in many cases, fixed in the range from 3.5 to the neutrality.

Since the alkaline or acid polishing slurry is, in many cases, utilized in this manner, the chemical resistance of the parts used in the CMP apparatus is important in enhancing the stability of the polishing apparatus. Particularly in the polishing process of a semiconductor wafer, the chuck structure for holding a sample is cited as a part which greatly influences the uniformity and the flattening of the wafer.

As for the chuck structure, a system of bonding a sample to a high precision flat plate by means of wax, a system of sucking and fixing a sample onto a high precision flat plate by means of vacuum suck and a template system wherein a sample is bonded onto a backing film which is a non woven fabric formed of a soft artificial leather are known. The bonding system by means of wax has a problem that lack of uniformity of the wax application greatly influences the polishing uniformity of the sample and the setting and releasing step through heating and cooling is necessary. And the template system by means of the backing film has a problem that aggregation grains are mixed in between the backing film and the wafer or a bubble is mixed in at the time of wafer suck so as to generate dimples and thereby the uniformity is deteriorated. In regard to these points, a vacuum suck system is adopted in many cases and the vacuum suck system has advantages that the number of polishing steps is smaller and the step management is simpler in comparison with other systems and the dimples on the wafer surface can be reduced.

In the case that the above described CMP apparatus is formed in accordance with the vacuum suck system, a chuck base made of ceramic where the lower surface is formed as a highly precise plane is utilized and pin holes of which the diameter is approximately 0.1 mm are provided at a few mm intervals over the entire surface of this chuck base. In addition, the chuck made of synthetic resin has been processed so as to have trenches on the suck surface toward a wafer so that the vacuum suck area is increased. In particular, for a sample which has a macroscopic waviness such as a semiconductor wafer, the vacuum suck and the surface standard polishing can be made effective by combining a chuck base which has the air permeability in the above manner and a chuck formed of a non woven fabric, rubber, resin, artificial leather, or the like which has the air permeability and the elasticity. Such a chuck structure is proposed by the present applicant in Japanese Patent Application Laid-Open No.8-181092(1996).

As described above, the chuck is stuck and fixed to the chuck base via an adhesive layer and the adhesive layer is formed of a commercially available acryl adhesive double coated tape or a resin based adhesive such as an epoxy resin or a light curing agent. In the case that the chuck is fixed to the chuck base by using an acryl adhesive double coated tape, however, the adhesive double coated tape is exposed to the acid and alkaline polishing slurry and the problem arises that the quality of the acryl resin on the outer periphery of the adhesive double coated tape is changed and this outer periphery becomes swollen due to moisture absorption so as to peel off from the chuck base. This is because the acryl acid ester ($R_1$—COO—$R_2$), which is the skeleton of the acryl adhesive double coated tape, undergoes hydrolysis in the acid or alkaline polishing slurry so that the adhesiveness is deteriorated.

In addition, in the case that the chuck is fixed to the chuck base by using a resin-based adhesive, there are problems that the elasticity is inferior to that of the adhesive double coated tape and therefore a pressure shock at the time of polishing movement cannot be buffered and in addition, the resin-based adhesive is swollen through the erosion by the polishing slurry and thereby the edge parts of the chuck is peeled off from the adhesive layer. In this manner, there is a problem that the edge parts of the chuck are peeled off and, thereby, the wafer cannot be stably fixed and the polishing uniformity of the wafer is deteriorated.

BRIEF SUMMARY OF THE INVENTION

An object of the present invention is to provide a sample polishing apparatus and a sample polishing method wherein the quality of the adhesive layer is not changed through the exposure to a washing liquid, chemicals, or the like, so that the sample suck pad (chuck) can be prevented from being peeled off and the polishing uniformity of a sample can be increased.

In a sample polishing apparatus according to the first aspect of the present invention which sucks and holds a sample onto a sample suck pad (chuck) that is stuck to a chuck base via an adhesive layer so that the surface of the sample is polished by making contact with a polishing pad while grinding, the adhesive layer includes a rubber-based material. The sample suck pad is stuck and fixed onto the chuck base by means of the adhesive layer which includes a rubber-based adhesive material. The rubber-based adhesive material is excellent in the chemical resistance, the swelling resistance, the heat resistance, the adhesiveness and the peeling resistance in comparison with the acryl-based adhesive material and, therefore, even in the case that the bonding part between the sample suck pad and the chuck base is exposed to the acid or alkaline polishing slurry and the washing liquid, the peeling of an edge of the sample suck pad does not occur. As a result, the uniformity of the sample polishing increases. Here, the rubber-based adhesive materials obtained by mixing one or a plurality of tackifier(s) such as phenol-based resin, modified phenol resin, ketone resin, alkyd resin, rosin-based resin, coumarone resin, styrene-based resin, petroleum resin, or vinyl chloride-based resin into one or a plurality of adhesive rubber(s) such as chloroprene rubber, nitrile butadiene rubber, acryl rubber, styrene butadiene rubber, styrene isoprene styrene, styrene butadiene styrene, styrene ethylene butadiene styrene, butyl rubber, polyisobutylene rubber, natural rubber, or polyisoprene rubber, are effective.

A sample polishing apparatus according to the second aspect of the present invention is obtained by covering, with a sealing layer, the outer periphery of the adhesive layer, according to the first aspect, which includes a rubber-based adhesive material. Since the sample suck pad is stuck and fixed onto the chuck base by means of the adhesive layer which includes a rubber-based adhesive material and the outer periphery of this adhesive layer is additionally covered with a sealing layer, the uniformity of the sample polishing is further increased.

In a sample polishing apparatus according to the third aspect of the present invention, the adhesive layer according to the first or the second aspects is replaced with a rubber adhesive double coated tape. The rubber adhesive double coated tape is used in order to fix the sample suck pad onto the chuck base. The rubber adhesive double coated tape has a synthetic resin film as a base material where a rubber-based adhesive material is bonded through thermo compression on both sides thereof. By using an adhesive double coated tape which has a base material, the adhesive layer can withstand the pressure shock at the time of polishing movement and the adhesive layer can be easily renewed. As for the basic material of the adhesive double coated tape, polyester, polyethylene, polyvinyl chloride, non woven fabric or the like are used and in particular, a polyester based synthetic resin, of which the moisture absorption is small, is preferable.

A sample polishing apparatus according to the fourth aspect of the present invention is obtained by making the shearing adhesive strength of the adhesive layer is approximately 1 MPa or more in the apparatus according to the first, the second or the third aspects. The adhesive strength differs greatly according to the characteristics of the adhesive material and the property and the surface characteristics of the body to be stuck and moreover the utilization environment is moisture and the load is received repeatedly and, therefore, the setting of a quantitative value is difficult. In the case that the sample suck pad and the chuck base are made of synthetic resin or stainless steel, of which the surface a sample is stuck is finished with a mirror surface, however, the shearing stress generated by the polishing pressure in the range of from 4.9 kPa (50 gf/cm$^2$) to 58.8 kPa (600 gf/cm$^2$) is approximately 2.45 kPa (25 gf/cm$^2$) to 29.4 kPa (300 gf/cm$^2$). At this time, the shearing adhesive strength which can avoid the edge peeling caused by the impact at the initial time of the polishing movement and by the repeated stress is found to be 0.98 MPa (10 kgf/cm$^2$) or more, that is to say, approximately 1 MPa or more after the rounding off. Here, in the case that an acryl adhesive double coated tape is used, the shearing adhesive strength thereof is approximately 392 kPa (4 kg/cm$^2$) and this degree of shearing adhesive strength cannot withstand the impact at the initial time of polishing movement and the repeated stress so that the edge peeling occurs.

In a sample polishing apparatus according to the fifth aspect of the present invention which sucks and holds a sample onto the sample suck pad which is stuck to the chuck base via the adhesive layer and which polishes the surface of the sample by making contact with the polishing pad while grinding, the outer periphery of the adhesive layer is covered with a sealing layer. The outer periphery of the adhesive layer to which the sample absorption pad and the chuck base are stuck is covered with the sealing layer. The sealing layer which is formed by applying a sealing material with moisture resistance to the outer periphery of the adhesive layer can block the adhesive layer from the washing liquid or the polishing slurry so as to prevent the change in the quality, and the swelling, of the adhesive layer. As a result, the uniformity of the sample polishing is increased.

A sample polishing apparatus according to the sixth aspect of the present invention is obtained by forming the sealing layer in the apparatus according to the second or fifth aspect of an elastic sealing material. Since the outer periphery of the adhesive layer is covered with the elastic sealing material, the influence of the pressure shock which is subjected to the adhesive layer at the time of polishing movement is buffered. Here, the elastic sealing materials are silicon-based material, modified silicon-based material, polysulfide-based material, polyurethane-based material, acryl-based material, butyl rubber-based material, styrene butadiene rubber-based material, or the like, as one component materials and silicon-based material, modified silicon-based material, polysulfide-based material, polyurethane-based material, epoxy-based material, or the like, as two component materials. In regard to the adhesiveness to the sample suck pad and the chuck base as well as in regard to moisture resistance, a silicon-based material of one component, or two components, or polysulfide-based material of two components are particularly preferable.

In a sample polishing apparatus according to the seventh aspect of the present invention, the surface roughening is carried out on the surface of the chuck base bonded with the adhesive layer and/or on the surface of the sample suck pad bonded with the adhesive layer in the apparatus according to any of the first to the sixth aspects so that the average roughness is 0.5 $\mu$m to 5.0 $\mu$m. The wettability with the adhesive layer is increased by roughening the bonded surface so as to cause an anchor effect and at the same time scales are removed so as to increase the adhesiveness and, thereby, the edge peeling of the sample suck pad is further prevented. As for the roughness of the bonded surface, the average roughness is preferably 0.5 $\mu$m to 5.0 $\mu$m. In the case of the average roughness is smaller than 0.5 $\mu$m, the wettability with the adhesive layer becomes insufficient in many cases so that there is the risk that the shearing adhesive strength will be reduced. In addition, in the case that the average roughness exceeds 5.0 $\mu$m, air comes into recesses of the rough surface so as to cause gaps which reduce the wettability. In addition, the gaps become the cause of stress concentration so that there is the risk that the shearing adhesive strength will be reduced.

A sample polishing method according to the eighth aspect of the present invention, which sucks and holds a sample onto the sample suck pad which is stuck to the chuck base via the adhesive layer and which polishes the surface of the sample by making contact with the polishing pad while grinding, has the step of sucking a sample onto the sample suck pad which is fixed to the chuck base via the adhesive layer that is described in any of the first to the seventh aspects and the step of polishing the sample by making contact with the polishing pad while grinding. At the time of polishing the sample while supplying acid or alkaline polishing slurry, the quality of the rubber-based adhesive material is not changed by the polishing slurry and, therefore, edge peeling of the sample suck pad is not caused. In addition, the bonded part between the sample suck pad and the chuck base makes no contact with the polishing slurry by means of the sealing layer and, therefore, the adhesive layer does not swell so as not to cause the edge peeling of the sample suck pad. As a result, the uniformity of the sample polishing is increased.

The above and further objects and features of the invention will more fully be apparent from the following detailed description with accompanying drawings.

DETAILED DESCRIPTION OF THE INVENTION

In the following, the present invention is concretely described in reference to the drawings showing the mode thereof.

Figure 1:
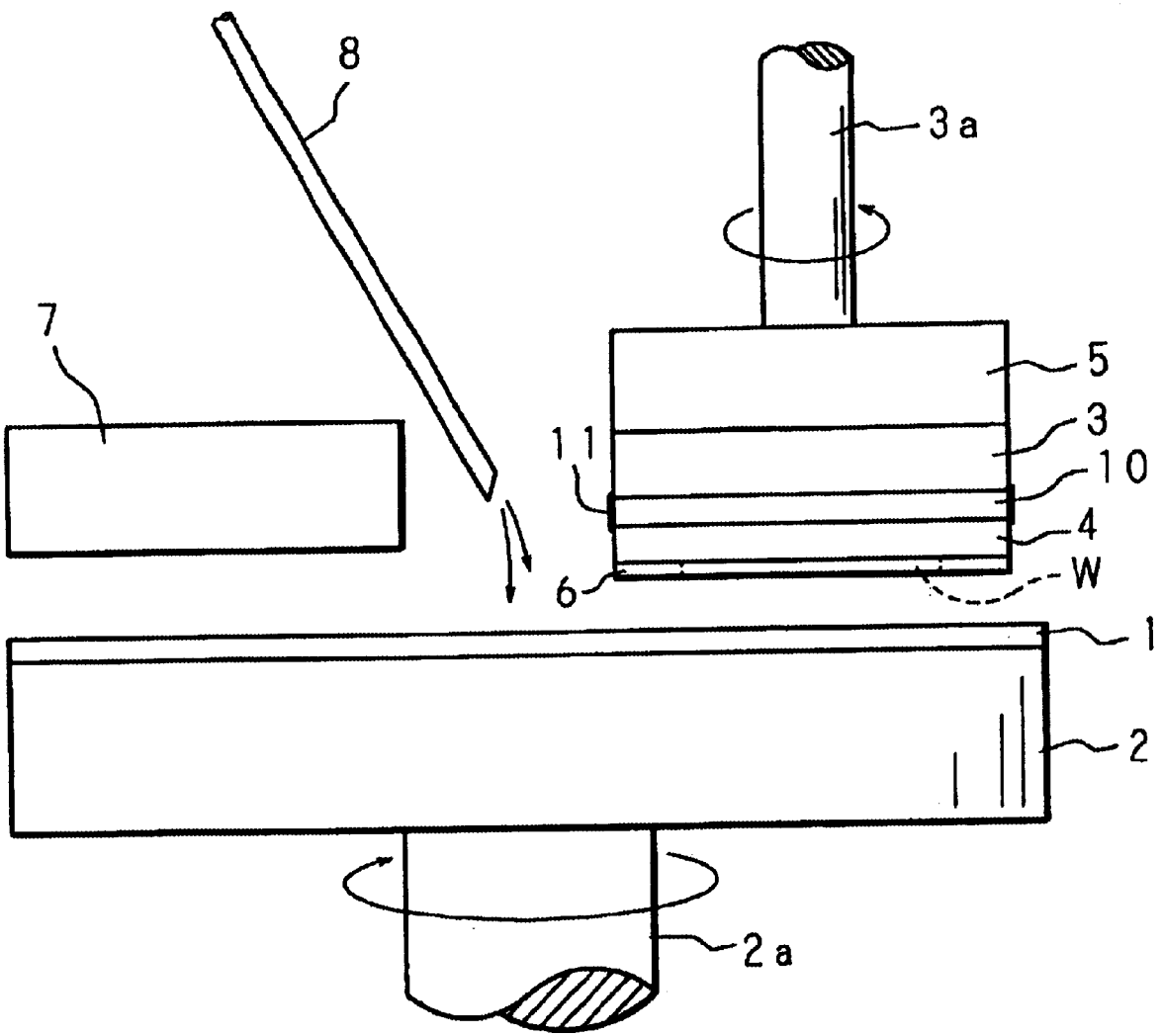
FIG. 1 is a schematic view showing the configuration of main parts of a sample polishing apparatus according to the present invention.

FIG. 1 is a schematic view showing the configuration of main parts of a sample polishing apparatus according to the present invention. As shown in the figure the sample polishing apparatus comprises a platen 2 in a thick disc form with a large diameter which is covered with a polishing pad 1 over the entirety of the upper surface thereof and a chuck base 3 in a thick disc form with a small diameter of which the lower surface faces the platen 2 and which holds, on the lower surface, a sample W such as a semiconductor substrate which is the polishing object. The chuck base 3 is formed of, for example, aluminum alloy or stainless steel. The platen 2 and the chuck base 3 are supported in a coaxial manner, by individual supporting axes 2*a* and 3*a* which are perpendicular to the respective opposite faces so as to be rotated around these supporting axes 2*a* and 3*a*, for driving. In addition, a diamond electrodeposition ring 7, of which the lower surface faces the platen 2 and which carries out in-situ dress of the polishing pad 1 at predetermined intervals, is provided in the platen 2 on the same side as the chuck base 3. A nozzle 8 is provided between the chuck base 3 and the electrodeposition ring 7 so as to face the platen 2 and polishing slurry is supplied to the surface of the platen 2 from the nozzle 8.

Figure 2:
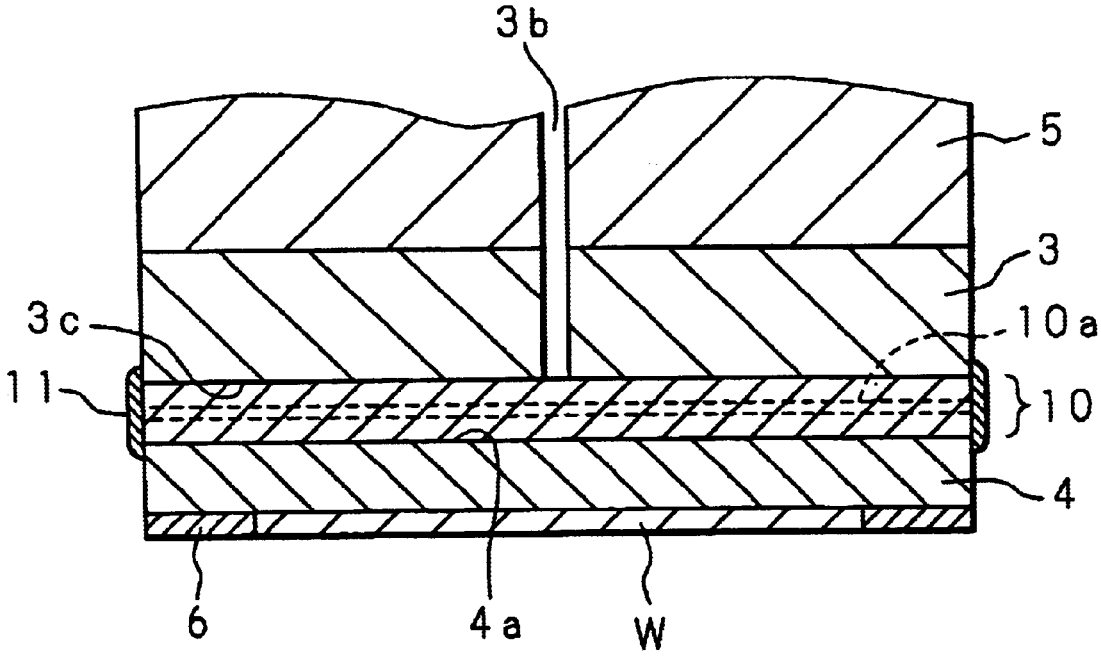
FIG. 2 is an enlarged cross section view showing the configuration of the sample holding mechanism of the sample polishing apparatus in FIG. 1.

FIG. 2 is an enlarged cross section view showing the configuration of the sample holding mechanism of the sample polishing apparatus in FIG. 1. As shown in FIG. 2, the chuck base 3 is linked to a head 5 which carries out the positioning in the horizontal direction and in the vertical direction above the platen 2. In addition, a suck path 3*b* is formed along the axis direction at the approximate center of the chuck base 3 and the suck path 3*b* is linked to a pump, which is not shown, so as to vacuum up the sample W onto a chuck 4 which is described below. The chuck (sample suck pad) 4 made of resin is stuck and fixed over the entirety of the lower surface 3*c* of the chuck base 3 with a rubber adhesive double coated tape (adhesive layer) 10. The rubber adhesive double coated tape 10 has the shearing adhesive strength of 1.96 MPa (20 kgf/cm$^2$). The outer periphery of the rubber adhesive double coated tape 10 and parts of the outer surfaces of the chuck base 3 and the chuck 4, which are linked to the tape, are covered with a sealing layer 11 so that the contact with the outside of the rubber adhesive double coated tape 10 is blocked. Here, the chuck 4 may be provided with pinholes or trenches formed on the suck surface toward the sample W as described above.

An annular retainer 6 is provided on the lower surface of the chuck 4 for preventing the sample W from flying out and for preventing the excessive polishing of the periphery part of the sample W, and the retainer 6 covers the sample W, from the outer side to the periphery part, which is sucked and fixed onto the lower surface of the chuck 4. Here, the chuck 4 is formed of a resin, as described above, which is easily processed to form pinholes, trenches, or the like. In addition, since the chuck 4 is of a flexible material, the polishing uniformity is increased by following the waviness of the sample W, such as a wafer, and damage to the sample at the time of polishing is prevented. In addition, the retainer 6 is required to have chemical resistance and swelling resistance to the polishing slurry as well as resistance to abrasion from the polishing pad 1 and from polishing grains, so the retainer 6 is formed of a ceramic or a specific resin, such as Teflon (registered trademark).

Bonding part of the chuck base 3 and the chuck 4 which characterizes the present invention is described in the following.

The chuck base 3 and the chuck 4 are stuck by means of the rubber adhesive double coated tape 10. The rubber adhesive double coated tape 10, having the thickness of approximately 0.1 mm, is formed a base material 10*a* made of a synthetic resin of approximately 25 μm shown with a broken line in FIG. 2 and a rubber-based adhesive material which is thermally pressed and fixed onto both sides of the base material 10*a*. Here, the rubber-based adhesive material is obtained by mixing one or a plurality of tackifier(s) such as phenol-based resin, modified phenol resin, ketone resin, alkyd resin, rosin-based resin, coumarone resin, styrene-based resin, petroleum resin, or vinyl chloride-based resin into one, or a plurality of, adhesive rubber(s) such as chloroprene rubber, nitrile butadiene rubber, acryl rubber, styrene butadiene rubber, styrene isoprene styrene, styrene butadiene styrene, styrene ethylene butadiene styrene, butyl rubber, polyisobutylene rubber, natural rubber, or polyisoprene rubber. These rubber-based adhesive materials are characterized by causing almost no hydrolysis in acid or alkaline chemical liquid and by having an extended longevity of adhesiveness.

For the base material 10*a* of the adhesive double coated tape 10, polyester, polyethylene, polyvinyl chloride, non-woven fabric, or the like, are used and, in particular, a polyester-based synthetic resin of low moisture absorption is preferable. In addition, the base material 10*a* is not limited to a single layer but, rather, may have a multi-layered laminate structure with two layers or more.

The lower surface 3*c* of the chuck base 3 and the upper surface 4*a* of the chuck 4, to which the rubber adhesive double coated tape 10 is bonded, are roughened. The surface roughening is carried out in accordance with the following procedure. As for the chuck base 3, made of aluminum alloy or stainless steel as described above, the lower surface 3*c* is roughened by means of polishing paper until the gloss is lost, is washed sufficiently with trichloroethylene and is dried. On the other hand, as for the chuck 4 made of resin, the upper surface 4*a*, to which the rubber adhesive double coated tape 10 is to be bonded, is wiped with approximately three passes of a clean cotton cloth, moistened with methyl alcohol, and is completely dried. After that, the upper surface 4*a* is roughened by means of polishing paper until the surface gloss is lost, the particles left on the upper surface 4*a* are wiped off with methyl alcohol and the surface is dried.

Here, the average roughness Ra of the lower surface 3*c* of chuck base 3 and the upper surface 4*a* of the chuck 4 is preferably 0.5 μm to 5.0 μm. In the case that the average roughness Ra is smaller than 0.5 μm, the wettability with the rubber adhesive double coated tape 10 becomes insufficient and three is the risk that the shearing adhesive strength will be reduced. In addition, in the case that the average roughness Ra exceeds 5.0 μm, air comes into the recesses of the roughened surface and gaps are generated so as to reduce the wettability. Moreover, the gaps become the cause of stress concentration and there is the risk that the shearing adhesive strength will be reduced.

As for the procedure of fixing the chuck base 3 and the chuck 4, wherein the surface roughening is carried out in the above manner, by means of the rubber adhesive double coated tape 10, first one surface of the rubber adhesive double coated tape 10 is bonded to the upper surface 4*a* of the chuck 4 so that no bubbles are formed. Next, the chuck 4 to which the rubber adhesive double coated tape 10 is bonded is pressed onto the lower surface 3*a* of the chuck base 3. After pressing, it is left in at room temperature while being hand pressed. Thereby, the adhesive material of the rubber adhesive double coated tape 10 flows into the uneven part of the roughened lower surface 3*c* so as to stabilize the shearing adhesive strength.

As described above, the outer periphery of the rubber adhesive double coated tape 10 is coated with the sealing layer 11 at the bonding part of the chuck base 3 and the chuck 4. This sealing layer 11 is formed of a sealing material with moisture resistance and is formed on the outer periphery surface of the above bonding part by using a spatula, or the like. At this time, the sealing material is applied uniformly on the related regions of the outer periphery surface of the chuck base 3 and the chuck 4, including the outer periphery of the rubber adhesive double coated tape 10, and is not applied to the lower surface of the chuck 4. In the case that the materials of the chuck base 3 and the chuck 4 are different and one type of sealing material forms the sealing layer 11, it is preferable that a proper intermediate layer, or an undercoating agent, is selected and is applied in advance. After the application of the sealing material it is left at room temperature.

Sealing materials are categorized into elastic types and inelastic types and, as for the sealing layer 11 according to the present invention, by utilizing an elastic sealing material the effects of pressure shock at the time of polishing movement can be buffered. The elastic sealing material is silicon-based material, modified silicon-based material, polysulfide-based material, polyurethane-based material, acryl-based material, butyl rubber-based material, styrene butadiene rubber-based material, or the like, as one component material and silicon-based material, modified silicon-based material, polysulfide-based material, polyurethane-based material, epoxy-based material, or the like, as two component materials. In particular, in regard to the adhesiveness to the chuck 4 and the chuck base 3 and in regard to moisture resistance, a silicon-based material of one component, or of two components, or a polysulfide-based material of two components is preferable. In addition, as an inelastic sealing material, a sealing material of a high hardness such as a glass pate, an oil-based caulking material or an asphalt-based sealing material is used.

The polishing by means of the above described sample polishing apparatus is carried out as follows: the sample W is sucked and held onto the chuck 4 which is stuck and fixed onto the chuck base 3 via the rubber adhesive double coated tape 10; the chuck base 3 and the platen 2, to which the polishing pad 1 is bonded, are drawn in proximity to each other through the upward and downward movements of either one, or both, of them while rotating around the respective supporting axes 3*a* and 2*a* so that the lower surface of the sample W (polishing surface) is pressed onto the surface of the polishing pad 1; and they make contact with each other while grinding via the polishing slurry supplied from the nozzle 8, which faces the center of the upper part of the platen 2.

In the above described sample polishing apparatus, since the chuck base 3 and the chuck 4 are stuck and fixed to each other by means of the rubber adhesive double coated tape 10, almost no hydrolysis occurs even when the bonding part is exposed to the acid, or alkaline, polishing slurry so that the peeling of the chuck 4 can be prevented. As a result, the polishing uniformity of the sample W is increased. In addition, since the outer periphery of the bonding part is covered with the sealing layer 11, the bonding part does not make contact with the polishing slurry and, therefore, the peeling of the chuck 4 can be further prevented. In addition, since the lower surface 3*a* of the chuck base 3 and the upper surface 4*a* of the chuck 4, to which the rubber adhesive double coated tape 10 is bonded, are roughened, the wettability with the rubber adhesive double coated tape 10 is increased so as to generate an anchor effect and so as to increase the adhesiveness by removing scales and, therefore, the edge peeling of the chuck 4 can be further prevented.

Here, though in the above described mode, the case where the rubber adhesive double coated tape 10 is used as the adhesive layer, there is no limitation to adhesive double coated tape as long as a rubber-based adhesive material is used and an adhesive tape formed of only an adhesive material without having a base material or a so-called adhesive tape without a base material may be used. Here, this adhesive tape without a base material is relatively difficult to handle at the time of bonding and the adhesive material tends to remain locally at the time of the renewal of the chuck 4 and, therefore, an adhesive double coated tape which has a base material is preferable as an adhesive layer. In addition, the chuck 4 and the chuck base 3 may be stuck by using a rubber adhesive single coated tape and a rubber-based adhesive agent or may be adhered by individually using a base material made of a synthetic resin and a rubber-based adhesive material as described above.

Embodiments 1 to 3

By using the above described sample polishing apparatus, polishing testing of 100 batches, respectively, for a 6 inch silicon thermal oxide film sheet wafer (2 $\mu$m $SiO_2$/Si) and for a 6 inch Cu film sheet wafer (2 $\mu$m Cu/0.3 $\mu$m TaN/0.1 $\mu$m $SiO_2$/Si) is sequentially carried out so that the polishing uniformity of both of these wafers and the edge peeling amount of the chuck 4 are measured. The results of the 200 batches are averaged and shown in TABLE 1. For the bonding of the chuck 4, a rubber adhesive double coated tape 10 of which the tape thickness is 0.11 mm (the thickness of the polyester base material is 25 $\mu$m) and of which the shearing adhesive strength is 1.96 MPa (20 kgf/cm$^2$) is used and, after pressing and bonding, the chuck 4 it is left for 24 hours at room temperature. In addition, as for the sealing layer 11, an oil-based caulking agent, which is a commercially available inelastic sealing material, is uniformly applied and left for 24 hours at room temperature.

- polishing pad 1:IC 1000/SUBA400 made by Roedeil Nitta (20×20 sections)
- polishing slurry for silicon oxide film: SS-25 made by Cabot Corporation (silica polishing grain concentration 12.5 wt %, pH=10.5)
- polishing slurry for Cu film: QCTT1010 made by Roedeil Corporation (alumina polishing grain concentration 2.6 wt %, $H_2O_2$ concentration=7.5 vol %, pH=3.8)
- chuck base 3: made of stainless steel and washed with trichloroethylene after surface roughening
- chuck 4: trenches are processed on the wafer suck surface and roughening is carried out on the surface to which the rubber adhesive double coated tape is bonded
- retainer 6: made of ceramic, retainer height is such that the retainer protrudes slightly from the wafer.

The above described components are utilized and, as for the polishing condition, the polishing time is 2 minutes and the polishing pressure is 29.4 kPa (300 gf/cm$^2$) and, further, scrub washing with pure water is carried out on wafers after the polishing and the wafers are dried with a nitrogen gas. Here, the column "surface roughening" in the TABLE indicates whether or not surface roughening is carried out on the surfaces of the chuck 4 and the chuck base 3 to which the adhesive double coated tape is adhered.

As for Embodiments 2 and 3, the same measurements as for Embodiment 1 are carried out using rubber adhesive double coated tapes 10 with different shearing adhesive strengths. In Embodiment 2 the shearing adhesive strength is 0.784 MPa (8 kgf/cm$^2$) and in Embodiment 3 the shearing adhesive strength is 0.98 MPa (10 kgf/cm$^2$). The other parts of the configuration, and the polishing conditions, are the same as for Embodiment 1. The results of these embodiments are also shown in TABLE 1. Here, the same measurement is carried out for a prior art wherein the chuck base and the chuck are stuck by using an acryl adhesive double coated tape. The tape thickness of the acryl adhesive double coated tape is 0.125 mm (thickness of the polyester base material is 25 $\mu$m), the shearing adhesive strengths are 0.784 MPa (8 kgf/cm$^2$) (Prior Art 1) and 1.176 MPa (12 kgf/cm$^2$) (Prior Art 2). In the prior arts, no sealing layer is formed and no roughening is carried out on the surfaces of the chuck base and the chuck to which the tape is bonded. The results of these Prior Arts 1 and 2 are also shown in TABLE 1.

Here, as for the "polishing uniformity", the film thickness after the polishing is measured at 140 points (2 mm pitch) over the entire surface except for at the edge part 5 mm from the periphery of the wafer and the average and the standard deviation of these measurement values are found so that the ratio of the latter to the former is indicated in percent (uniformity $\sigma$=(standard deviation/average)×100). In general, the uniformity $\sigma$ is targeted at approximately 5%. In addition, the column of "judgment" has a 4 stage evaluation based on the polishing uniformity (%).

As is clear from TABLE 1, in comparison with Prior Arts 1 and 2, the edge peeling amounts of the chucks are 1.2 mm, 2.3 mm and 1.3 mm, which are found to be small, and the polishing uniformity of wafers are 6.9%, 8.1% and 7.0%, which are found to be high, in Embodiments 1 to 3. In addition, in Embodiments 1 and 3 where the shearing adhesive strength of the tape is 0.98 MPa, or more, the polishing uniformity is particularly excellent. Though the judgment of Embodiment 2 is 'Δ', the polishing uniformity of 8.1% is at a level which can be put into practical use.

Embodiment 4

A sample polishing apparatus is used wherein an elastic sealing material is used for the sealing layer and the other parts of the configuration are the same as in Embodiment 1, so as to carry out the same measurements as in Embodiment 1. The results are shown in TABLE 2. As is clear from TABLE 2, the edge peeling amount of the chuck is 0 mm and the polishing uniformity of the wafers 5.1%, which represents a high uniformity.

Embodiments 5 to 10

A sample polishing apparatus is used wherein the roughness of the surfaces of the chuck base and the chuck to which the tape is bonded is changed and the other parts of the configuration are same as in Embodiment 1, so as to carry out the same measurements as in Embodiment 1. Surface roughening is carried out so that the average roughness (Ra) becomes, respectively, 0.3 $\mu$m (Embodiment 5), 0.5 $\mu$m (Embodiment 6), 1.0 $\mu$m (Embodiment 7), 4.0 $\mu$m (Embodiment 8), 5.0 $\mu$m (Embodiment 9) and 7.0 $\mu$m (Embodiment 10). The results are shown in TABLE 3.

As is clear from TABLE 3, the edge peeling amount of the chuck is found to be small and the polishing uniformity of wafers is found to be high in all of Embodiments 5 to 10. In addition, the edge peeling amount of the chuck is 0 mm and the polishing uniformity is 5.0%, 5.1%, 5.2% and 5.2% in Embodiments 6 to 9, which is particularly excellent, and the average roughness (Ra) of the surfaces of the chuck base and the chuck, to which the tape is bonded, is 0.5 $\mu$m to 5.0 $\mu$m.

From the measurement results of the polishing uniformity of Embodiments 1 to 10, as described above, it is found to be preferable for the rubber adhesive tape to have the shearing adhesive strength of 0.98 MPa (10 kgf/cm$^2$), or more, that is to say approximately 1 MPa, or more. In addition, the above described effects can be confirmed in the sample polishing apparatuses according to the modes of the present invention. Here, the upper limit of the shearing adhesive strength of the rubber adhesive tape is the value which makes it possible to renew the adhesive tape.

As described above, in the present invention, since the sample suck pad is stuck and fixed onto the chuck base by using a rubber-based adhesive material which is excellent in the properties of chemical resistance, swelling resistance, temperature withstanding, adhesiveness and peeling resistance in comparison with an acryl adhesive material, the edge peeling of the sample suck pad will not occur even when this bonding part is exposed to the acid or alkaline polishing slurry and washing liquid and, therefore, the uniformity of the sample polishing is increased. In addition, since the outer periphery of the adhesive layer is covered with a sealing material with moisture resistance, the present invention has the excellent effects wherein the adhesive layer is blocked off from the washing liquid and the polishing slurry so that change in the quality of, and the swelling of, the adhesive layer are prevented so as to increase the uniformity of the sample polishing.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

TABLE 1

| | EMBODIMENT | | | PRIOR ART | |
|---|---|---|---|---|---|
| | 1 | 2 | 3 | 1 | 2 |
| DOUBLE COATED TAPE | RUBBER-BASE | RUBBER-BASE | RUBBER-BASE | ACRYL-BASE | ACRYL-BASE |
| SHEARING ADHESIVE STRENGTH (MPa (kgf/cm$^2$)) | 1.96 (20) | 0.784 (8) | 0.98 (10) | 0.784 (8) | 1.176 (12) |

TABLE 1-continued

| | EMBODIMENT | | | PRIOR ART | |
|---|---|---|---|---|---|
| | 1 | 2 | 3 | 1 | 2 |
| SURFACE ROUGHENING | YES | YES | YES | NO | NO |
| SEALING MATERIAL | INELASTIC | INELASTIC | INELASTIC | NONE | NONE |
| EDGE PEEL AMOUNT (mm) | 1.2 | 2.3 | 1.3 | 9.5 | 8.9 |
| POLISHING UNIFORMITY σ (%) | 6.9 | 8.1 | 7.0 | 12.1 | 11.3 |
| JUDGMENT | ○ | Δ | ○ | X | X |

TABLE 2

| | EMBODIMENT 4 |
|---|---|
| DOUBLE COATED TAPE | RUBBER-BASE |
| SHEARING ADHESIVE STRENGTH (MPa(kgf/cm$^2$)) | 1.96 (20) |
| SURFACE ROUGHENING | YES |
| SEALING MATERIAL | ELASTIC |
| EDGE PEEL AMOUNT (mm) | 0 |
| POLISHING UNIFORMITY σ (%) | 5.1 |
| JUDGMENT | ⊙ |

TABLE 3

| | EMBODIMENT | | | | | |
|---|---|---|---|---|---|---|
| | 5 | 6 | 7 | 8 | 9 | 10 |
| DOUBLE COATED TAPE | RUBBER-BASE | RUBBER-BASE | RUBBER-BASE | RUBBER-BASE | RUBBER-BASE | RUBBER-BASE |
| SHEARING ADHESIVE STRENGTH (MPa(kgf/cm$^2$)) | 1.96 (20) | 1.96 (20) | 1.96 (20) | 1.96 (20) | 1.96 (20) | 1.96 (20) |
| AVERAGE ROUGHNESS OF BONDING SURFACE (μm) | 0.3 | 0.5 | 1.0 | 4.0 | 5.0 | 7.0 |
| SEALING MATERIAL | INELASTIC | INELASTIC | INELASTIC | INELASTIC | INELASTIC | INELASTIC |
| EDGE PEEL AMOUNT (mm) | 1.3 | 0 | 0 | 0 | 0 | 0 |

TABLE 3-continued

| | EMBODIMENT | | | | | |
|---|---|---|---|---|---|---|
| | 5 | 6 | 7 | 8 | 9 | 10 |
| POLISHING UNIFORMITY σ (%) | 7.0 | 5.0 | 5.1 | 5.2 | 5.2 | 6.9 |
| JUDGMENT | ○ | ◎ | ◎ | ◎ | ◎ | ○ |

What is claimed is:

1. A sample polishing apparatus, comprising:

a chuck base;

a sample suck pad which sucks and holds a sample;

an adhesive layer which is interposed between said chuck base and said sample suck pad and which sticks said sample suck pad onto said chuck base; and a polishing pad which polishes a surface of said sample, wherein said adhesive layer includes a rubber-based adhesive material.

2. The sample polishing apparatus according to claim 1, further comprising:

a sealing layer which covers an outer periphery of said adhesive layer.

3. The sample polishing apparatus according to claim 2, wherein said adhesive layer is a rubber adhesive double coated tape.

4. The sample polishing apparatus according to claim 2, wherein the shearing adhesive strength of said adhesive layer is approximately 1 MPa or more.

5. The sample polishing apparatus according to claim 2, wherein said sealing layer is formed of an elastic sealing material.

6. The sample polishing apparatus according to claim 1, wherein said adhesive layer is a rubber adhesive double coated tape.

7. The sample polishing apparatus according to claim 6, wherein the shearing adhesive strength of said adhesive layer is approximately 1 MPa or more.

8. The sample polishing apparatus according to claim 1, wherein the shearing adhesive strength of said adhesive layer is approximately 1 MPa or more.

9. The sample polishing apparatus according to claim 1, wherein the surface of said chuck base bonded with said adhesive layer and/or the surface of said sample suck pad bonded with said adhesive layer are roughened so that the average roughness thereof is 0.5 μm to 5.0 μm.

10. A sample polishing apparatus, comprising:

a chuck base;

a sample suck pad which sucks and holds a sample;

an adhesive layer which is interposed between said chuck base and said sample suck pad and which sticks said sample suck pad onto said chuck base;

a sealing layer which covers an outer periphery of said adhesive layer; and a polishing pad which polishes a surface of said sample.

11. The sample polishing apparatus according to claim 10, wherein said sealing layer is formed of an elastic sealing material.

12. The sample polishing apparatus according to claim 10, wherein the surface of said chuck base bonded with said adhesive layer and/or the surface of said sample suck pad bonded with said adhesive layer are roughened so that the average roughness thereof is 0.5 μm to 5.0 μm.

13. A sample polishing method wherein a sample is sucked and held on a sample suck pad which is stuck to a chuck base via an adhesive layer and a surface of said sample is made contact with a polishing pad so as to be polished, comprising the steps of:

making said sample suck pad, which is fixed onto said chuck base via the adhesive layer including a rubber-based adhesive material, suck a sample; and polishing said sample by making contact with said polishing pad.

14. The sample polishing method according to claim 13, wherein an outer periphery of said adhesive layer is covered by a sealing layer.

15. The sample polishing method according to claim 13, wherein said adhesive layer is a rubber adhesive double coated tape.

16. The sample polishing method according to claim 13, wherein the shearing adhesive strength of said adhesive layer is approximately 1 MPa or more.

17. The sample polishing method according to claim 13, wherein the surface of said chuck base bonded with said adhesive layer and/or the surface of said sample suck pad bonded with said adhesive layer are roughened so that the average roughness thereof is 0.5 μm to 5.0 μm.

18. A sample polishing method wherein a sample is sucked and held on a sample suck pad which is stuck to a chuck base via an adhesive layer and a surface of said sample is made contact with a polishing pad so as to be polished, comprising the steps of:

making said sample suck pad, which is fixed onto said chuck base via the adhesive layer, suck a sample, wherein an outer periphery of said adhesive layer being covered by a sealing layer; and polishing said sample by making contact with said polishing pad.

19. The sample polishing method according to claim 18, wherein said sealing layer is formed of an elastic sealing material.

20. The sample polishing method according to claim 18, wherein the surface of said chuck base bonded with said adhesive layer and/or the surface of said sample suck pad bonded with said adhesive layer are roughened so that the average roughness thereof is 0.5 μm to 5.0 μm.

* * * * *